US006528945B2

(12) United States Patent
Kelly et al.

(10) Patent No.: US 6,528,945 B2
(45) Date of Patent: Mar. 4, 2003

(54) SEAL FOR CERAMIC METAL HALIDE DISCHARGE LAMP

(75) Inventors: Timothy Lee Kelly, Boston, MA (US); Jagannathan Ravi, Bedford, MA (US)

(73) Assignee: Matsushita Research and Development Laboratories Inc, Waborn, MA (US)

( * ) Notice: Subject to any disclaimer, the term of this patent is extended or adjusted under 35 U.S.C. 154(b) by 142 days.

(21) Appl. No.: 09/776,253

(22) Filed: Feb. 2, 2001

(65) Prior Publication Data

US 2002/0145388 A1 Oct. 10, 2002

(51) Int. Cl.[7] ..... H01J 17/18
(52) U.S. Cl. ..... 313/623; 313/634
(58) Field of Search ..... 313/623, 624, 313/625, 634, 638, 639

(56) References Cited

U.S. PATENT DOCUMENTS

| | | | | |
|---|---|---|---|---|
| 3,848,151 A | * | 11/1974 | McVey | 313/625 |
| 4,851,733 A | * | 7/1989 | Kuus et al. | 313/623 |
| 5,075,587 A | | 12/1991 | Pabst et al. | 313/633 |
| 5,352,952 A | | 10/1994 | Juengst | 313/623 |
| 5,404,077 A | | 4/1995 | Eichelbronner et al. | 313/623 |
| 5,404,078 A | | 4/1995 | Bunk et al. | 313/623 |
| 5,424,608 A | | 6/1995 | Juengst et al. | 313/623 |
| 5,424,609 A | * | 6/1995 | Geven et al. | 313/623 |
| 5,446,341 A | | 8/1995 | Hoffman et al. | 313/623 |
| 5,532,552 A | | 7/1996 | Heider et al. | 313/623 |
| 5,552,670 A | | 9/1996 | Heider et al. | |
| 5,592,049 A | | 1/1997 | Heider et al. | 313/623 |
| 5,637,960 A | | 6/1997 | Juengst et al. | 313/623 |
| 5,742,123 A | | 4/1998 | Nagayama | 313/623 |

OTHER PUBLICATIONS

Journal of the Ceramic Society of Japan, Chu et al. Slip Casting of Continuous Functionally Gradient Material 1993, No Month.

* cited by examiner

*Primary Examiner*—Michael H. Day

(57) ABSTRACT

A high pressure discharge lamp formed of a polycrystalline alumina ceramic arc tube which includes a discharge zone and end tubes on each side to seal the tube, the discharge zone containing light emitting metal halides and mercury and a starting gas of argon or xenon. The end tubes have longitudinally extending openings therein. The end tubes have proximal ends adjacent the arc tube and distal ends furthermost removed from the arc tube. An electrical feed through is disposed in each of the end tubes which includes a thin metal foil section disposed between two electrically conductive lead in wire wires. One of the lead in wire wires has an electrode disposed thereon. A sealing compound seals the electrical feed through to the alumina of the end tubes at the outer ends thereof.

11 Claims, 5 Drawing Sheets

SEAL FOR CERAMIC METAL HALIDE DISCHARGE LAMP

FIELD OF THE INVENTION

The present invention relates to the design and manufacture of high pressure discharge lamps using ceramic arc tubes. Furthermore, the invention relates to a ceramic metal halide lamp which requires very little change in the manufacturing technology. The field covers any discharge lamp in a ceramic envelope, of any shape, size, power and configuration.

BACKGROUND OF THE INVENTION

Metal halide lamps in ceramic arc tubes are relatively new entrants in the field of lighting. Since they can be operated at higher temperatures than lamps with quartz arc tubes, they are capable of better performance in measures such as luminous efficacy, color rendering and color stability. The recurring difficulty is obtaining a reliable seal between the arc tube ceramic and the electrical feed through.

High pressure sodium lamps (HPS) employ niobium as the feed through material since its thermal coefficient of expansion (TCE) is well matched to that of alumina. It is joined to the alumina by a ceramic sealing compound of similar thermal expansion coefficient as PCA (polycrystalline alumina) or niobium. The sealing compound is also resistant to sodium attack at elevated temperatures during lamp operation.

Without extensive modifications, this arrangement is unsuitable for ceramic metal halide (CMH) lamps since the salts are corrosive to both the niobium and sealing compound even at the lower cold spot temperatures usual for metal halide lamps. Consequently, a variety of attempts have been made and reported to overcome the sealing problem in CMH lamps.

Metals which are resistant to halides and may be used as feed throughs are molybdenum, tungsten, platinum, rhodium, rhenium, etc. These refractory metals, however, have a lower TCE than that of alumina (Table 1). Large differences in TCE result in separation between the metallic feed through and the ceramic arc tube body especially under thermal cycling during lamp operation and life. The separation causes seal leaks and even fracture leading to loss of hermeticity. Various methods of adaptation have been reported to overcome the thermal mismatch problem.

TABLE 1

Thermal Coefficient of Expansion of Commonly Used or Possible CMH Lamp Materials

| | |
|---|---|
| Alumina | ~8.0 × $10^{-6}$/K |
| Aluminum nitride | ~5.4 × $10^{-6}$/K |
| Niobium | ~8.0 × $10^{-6}$/K |
| Molybdenum | ~6.0 × $10^{-6}$/K |
| Tungsten | ~5.2 × $10^{-6}$/K |

In general, the sealing methods for the feed through to the arc tube body can be divided into one or more of the following four categories: sealing compound, sintering, graded seal and new arc tube materials. In many cases, the categories overlap in practice (for example, the use of graded plug material to effect a seal by sintering).

The most common design of CMH lamp arc tubes includes a PCA tube with narrow diameter capillary tube end sections. This construction results in lower temperature in the seal area during lamp operation. The electrode feed through is in three parts, a small diameter niobium rod and tungsten electrode at either end bridged by a halide resistant middle section. The middle section may be a molybdenum rod and/or coil or cermet. A ceramic sealing compound that is more halide resistant than the one used in HPS lamps makes the seal between the PCA and niobium rod. A protective layer over the niobium rod is formed by the melted sealing compound itself. This arc tube construction makes use of the well known HPS type sealing method (alumina to niobium via sealing compound) and processes (glove box sealing) with sufficient modifications to enable a long life CMH lamp. Other CMH arc tube constructions that make use of different sealing methods such as direct sintering of PCA to feed through, use of cermets and graded seals or even the use of new arc tube materials that will enable straight sealing with molybdenum or tungsten have been reported. There have been occasional introductions of lamps that used a cermet to replace niobium. But these alternate methods have not yet been able to demonstrate an overall advantage in areas of improved lamp performance, lower cost or adaptability to existing lamp factory processes.

SUMMARY OF THE INVENTION

An object of this invention is to substitute a part most prone to halide attack in the standard ceramic metal halide arc tube construction while minimizing the thermal stress between the new feed through and PCA. Another object of this invention is to reduce the manufacturing cost of a CMH lamp.

In the ceramic metal halide lamp designs utilized most widely, niobium is used as the feed through material in order to enable a hermetic seal to the PCA. While its TCE is most favorable for plugging a PCA arc tube, it cannot withstand the very corrosive reactions with the metal halide constituents within the arc tube. Hence, extraordinary steps are taken to minimize these reactions. The seal area is located far from the arc zone in order to lower the temperature substantially. Secondly, the surface area of the niobium feed through is reduced by changing to a small diameter rod from the tubular form common in HPS lamps. Further, the exposed niobium rod within the arc tube is protected by the melted sealing compound. This construction, although successful, comes at a great price due to the necessity for a three part electrode and the difficulty of assembling the same. Additionally, lamp design freedom is restricted by the choice of metal halides that are compatible with this construction.

If niobium can be eliminated from CMH lamps, there is potential for enormous reduction in the manufacturing costs and great possibilities for new lamps as well, although thermal stress and corrosion must be considered. Different types of HID lamps were analyzed to suggest alternatives for the CMH seal design. For example, it has been found by many investigators that molybdenum in either tube or rod form was unsuitable as a feed through for PCA bodies because of the large mismatch in the TCE. However, molybdenum is used as feed through in such long lived lamps as mercury vapor and quartz metal halide lamps despite the mismatch in TCE between molybdenum and quartz or hard glass being much greater than between molybdenum and PCA (TCE of quartz ~0.5×$10^{-6}$/K).

In quartz metal halide lamps, the thermal stress is kept to such a low level that it does not cause seal failure. The molybdenum at the sealing location is in the form of a thin foil whose thickness is much less than the diameter of a rod that would be required to carry the same current. In addition, the foil edges are feathered or beveled thus shaping the ends to point edges of negligible thickness.

According to the present invention, it was found that a similar approach may be adapted for CMH lamps as well. The molybdenum foil takes the place of niobium rod for sealing to PCA. The PCA capillary bore was modified so that a slit was formed at the outer end that would accept a molybdenum foil section. The width of the slit is substantially the same as the width of the molybdenum foil section. The diameter of the capillary bore is between about 0.5 and 3.0 mm. The electrode feed through assembly was made similar in appearance and construction as those in quartz metal halide lamps. Unlike with quartz, sealing between the PCA and the molybdenum foil cannot be made by melting and pressing the alumina. Instead, a sealing compound was used. Such sealing compounds comprise alumina and one or more of other oxides of silicon, dysprosium, strontium, barium, yttrium, calcium, etc. In practice, HPS lamp sealing compounds contain alumina, calcium, yttria, strontia, etc., while CMH lamp sealing compounds are usually made up of alumina, silica, dysprosia, etc. The arc tube had a good hermetic seal after the sealing process with good adherence of the sealing compound to the molybdenum foil.

A lamp was made with the arc tube of the new construction. It was operated for hundreds of hours where it was cycled on and off repeatedly. It was surprisingly found that the lamp operated without any seal failure. The present invention is based on the above discovery.

BRIEF DESCRIPTION OF THE DRAWINGS

FIG. 4 is a cross sectional view of the arc tube of the present invention showing the new feed through.

DETAILED DESCRIPTION OF THE PREFERRED EMBODIMENTS

Figure 1:
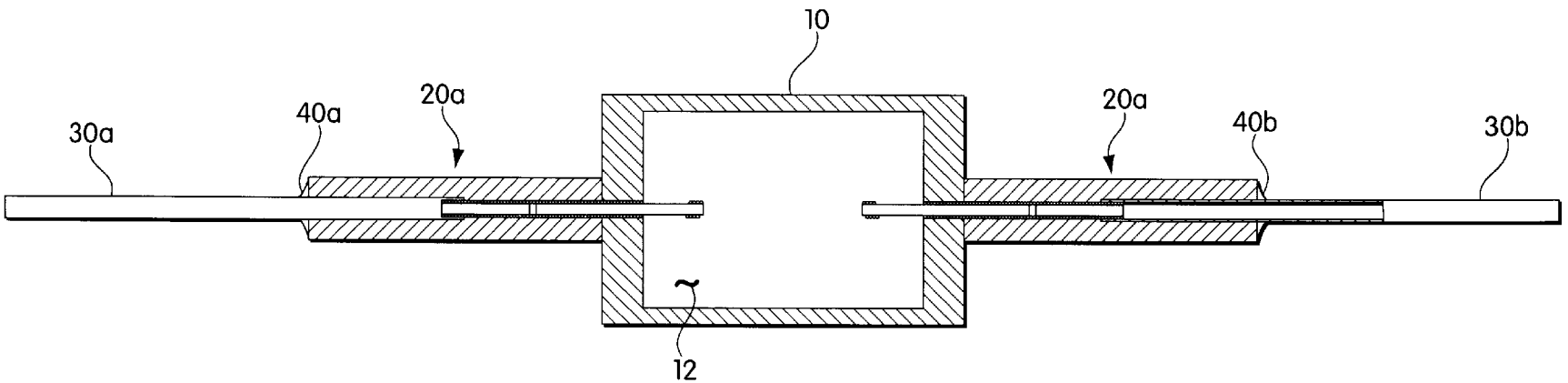
Fig. 1 Prior Art
FIG. 1 is a cross section of an arc tube of a typical CMH lamp.

The arc tube of a standard CMH lamp is shown in FIG. 1. The PCA body consists of an alumina arc chamber 10 and two alumina end zones 20*a* and 20*b*. Each end zone contains a narrow bore that accommodates the electrode feed through 30*a* and 30*b*. The lead in wire of the electrode feed through is joined to the alumina of the end zone by a sealing compound 40*a* and 40*b*. An arc tube fill 12 contains various metal halides and mercury which emit light during lamp operation and a starting gas such as argon or xenon.

Figure 2:
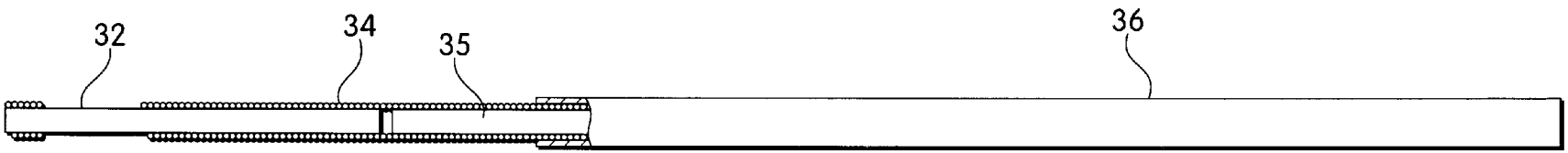
Fig. 2 Prior Art
FIG. 2 is a side elevational view, in partially in cross section showing an electrode rod feed through for the above arc tube.

A conventional electrode feed through, FIG. 2, consists of a tungsten electrode 32, a middle section 35 and the niobium in-lead section 36. The middle section is variously made of a molybdenum rod and/or coil or, in some instances, a cermet. A molybdenum coil 34 is very often employed to decrease the annular space between the feed through and the alumina capillary to reduce the condensation of the metal halide salts in this region. This construction requires welding a molybdenum rod of smaller diameter to the niobium lead in wire. The feed through is made of multiple parts to limit the length of niobium within the arc tube. A melted sealing compound flows completely around and beyond the niobium rod to form a protective surface over the niobium to protect it from the chemical reactions due to the halides. However, the electrode assembly is more complex since butt welds or crimpings are required along the feed through rod axis. If the niobium is eliminated, the electrode construction can be simplified and made more resistant to halide attack as well. Doing away with niobium has also the advantage that the exposure length of the sealing compound within the arc tube can be kept to a minimum.

Figure 3:
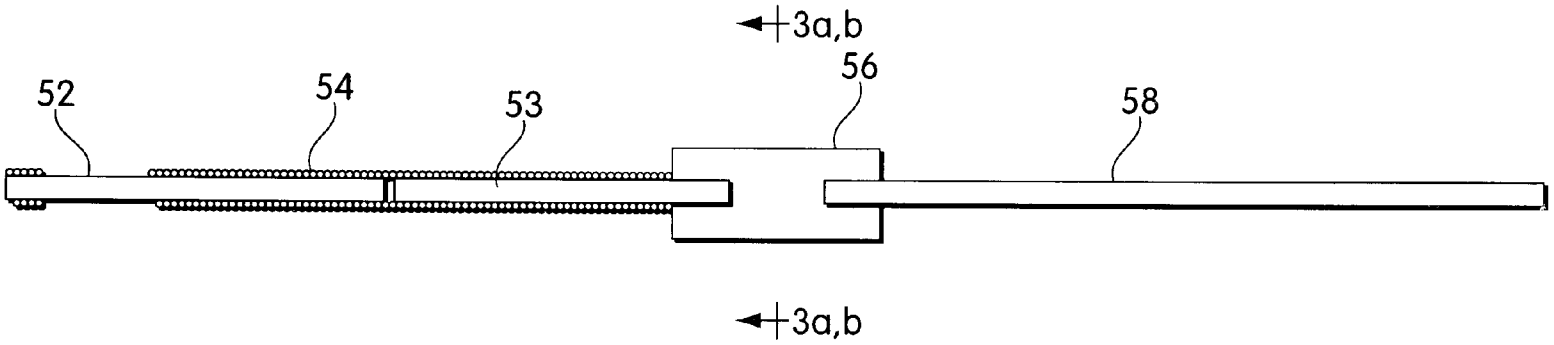
FIG. 3 is side elevational view, in partially in cross section, of the electrode feed through of the present invention.
Figure 3A:
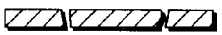
FIGS. 3*a* and 3*b* are cross sections of two embodiments of the foil section taken along the line 3—3, one with the edges beveled and the other with the edges not beveled.
Figure 3B:
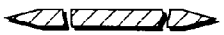

An embodiment for the new electrode feed through is given in FIG. 3. The tungsten electrode 52 and the middle section 53 (molybdenum rod/coil or cermet) are present as in the standard designs. A cermet is a composite of ceramic and metal, typically thermally fired from a powder mixture. In the feed through, as above, the cermet rod is composed of alumina and molybdenum with alumina being between 30%–70% by weight. The niobium at the sealing area is replaced by a molybdenum foil 56 of thickness of less than 0.5 mm. The thermal stresses, reduced to a great extent because of the thin foil used, can be made lower still by the use of beveled edges on the molybdenum foil (FIGS. 3*a* and 3*b* show the cross sections of the molybdenum foil for these embodiments). In the construction shown in FIG. 3, a molybdenum rod 53 is welded to the foil 56. As before, a molybdenum coil covers both the molybdenum rod and the portion of the tungsten electrode in the capillary.

The foils may be kept long enough to allow external electrical attachments to the completed arc tube. Alternately, molybdenum rod may be welded to the foil to serve as the lead in wire 58. In the latter case, it may be advantageous to seal a portion of the in lead to the alumina in order to provide for stiffness of the lead in wire for attachment purposes. The molybdenum foil may be doped with metal oxide particles such as yttrium oxide in order to improve its mechanical and thermal properties.

Figure 4:
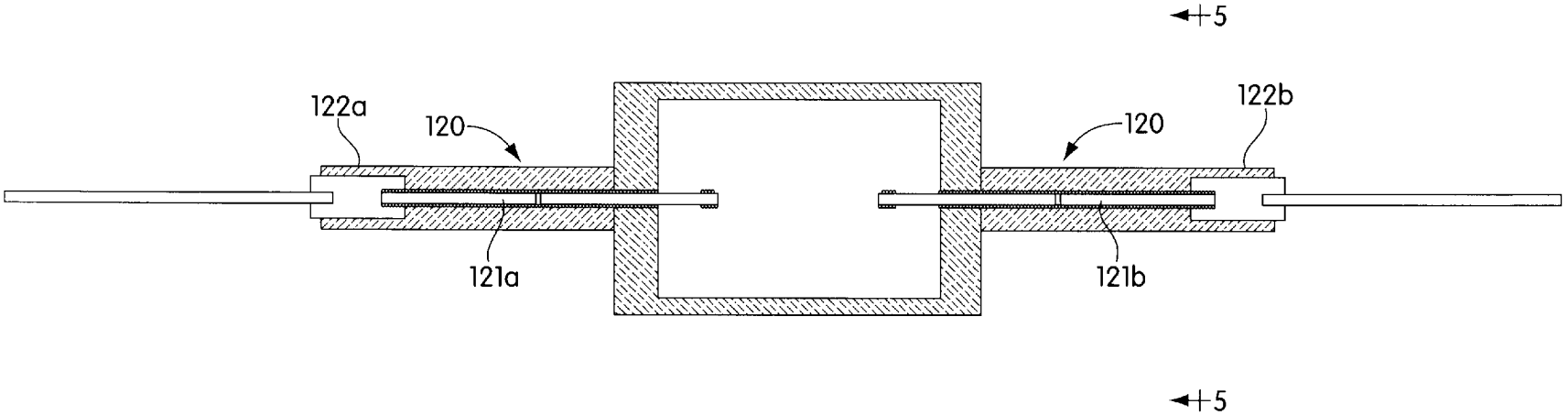
Figure 5:
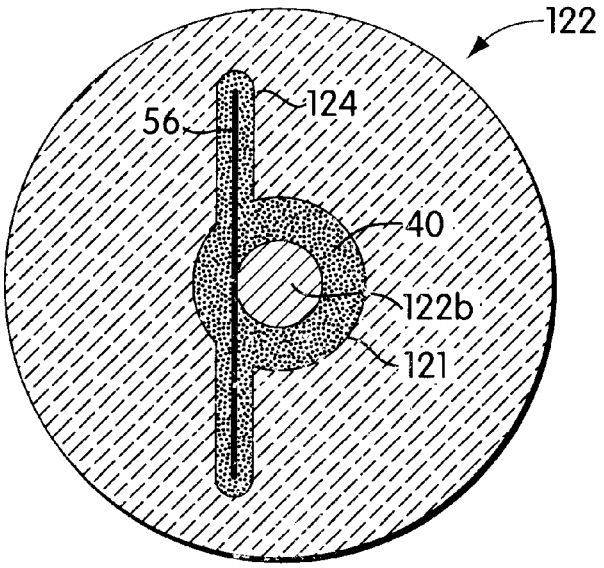
FIG. 5 is a cross sectional view 5—5 of the end section of FIG. 4 showing a hole shape construction for this embodiment.

A CMH arc tube incorporating the new electrode feed through is shown in FIG. 4. There is a slight difference in the PCA tube from the standard construction. In the end zones 120, instead of a cylindrical bore to house the rod type electrode feed through, there is a slit in each distal outer ends 122*a* and 122*b*, in addition to the cylindrical bore 121*a* and 121*b*. This slit, shown in greater detail in a cross section view shown in FIG. 5, extends to a depth of about 5 mm. FIG. 5 shows the bore 121 and slit 124 in the cross section of the PCA distal outer end 122. The molybdenum rod 53 and foil 56 can also be seen in this view. The melted sealing compound 40 flows around the foil and rod joining them to the PCA. Sealing compounds which may be used were given in the previous section. The slit need be no more than about 0.5 mm greater than the foil in any dimension.

Ideally, the corners of the slit will be rounded in order to prevent cracks from originating at the sharp edges. These measures, including the slit dimensions, are purely precautionary as the sealing compound, which is well matched to the PCA thermally, will flow into the crevices between the molybdenum foil and the PCA when it is in the molten state during the sealing process.

Figure 6:
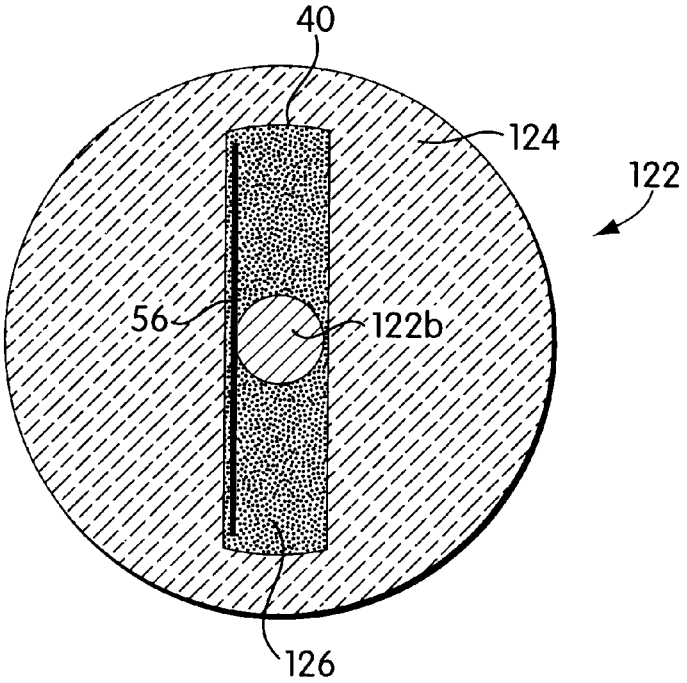
FIG. 6 is a cross sectional view showing an alternate end construction for the arc tube of FIG. 4.

The slit and the through hole in the end tubes may be readily formed in the PCA in the green state prior to sintering and as such would not entail significant processing costs for the manufacturer. Yet another variation instead of the slit in the capillary tube of the end zone is to have a larger diameter bore that can accommodate the foil. This larger bore which is typically only a few millimeters deep from the outside end is concentric with the narrow bore that extends the length of the capillary zone. The PCA arc tube body end section with this construction is shown in a cross sectional view in FIG. 6. The PCA end section 120 has a larger bore at the distal outer end 122. The space between the molybdenum rod 53 and foil 56 of the feed through is mostly occupied by the alumina inserts 126. The sealing compound 40 joins the different pieces as shown in the drawing. The inserts 126 are ceramic pieces with thermal expansion similar to that of PCA. In the embodiment of FIG. 6, they were formed by axially cutting into two pieces a section of alumina rod of diameter slightly less than the bore diameter at the outer end 122 of the PCA end section. The length of the pieces should be long enough to substantially fill the bore volume surrounding the molybdenum foil 56. The inserts reduce the amount of sealing compound required as well as eliminate possible gaps in the interface between the foil and the capillary tube. They also support the electrode feed through during sealing.

Compared to a conventional CMH electrode assembly, it is important to note that the electrode assembly with the molybdenum foil is easier to assemble because the attachment of the leads to the foil is by means of simple overlapping welds. There are additional savings to the lamp manufacturer in not having to carry the inventory and process costs for extra material, niobium. The arc tube sealing process is also simplified since factors like the protrusion length of the niobium lead in wire within the arc tube, the flow of the sealing compound in the capillary tube, etc., are not as critical or relevant for lamp life. The overall reliability of the CMH lamp is thus increased at a lower manufacturing cost.

What has been disclosed here are some basic embodiments of the present invention. It will be apparent to those skilled in the art that many variations of the constructions described are possible without deviating from the essence of this invention.

We claim:

1. A high pressure discharge lamp comprising a polycrystalline alumina ceramic arc tube forming a discharge zone and means on both sides thereof to seal said tube, said discharge zone containing light emitting materials comprising metal halides and mercury and a starting gas comprising argon or xenon;

said means to seal said tube comprising alumina end tubes having a longitudinally extending openings therein disposed at each end of said arc tube and sealed thereto, said end tubes having proximal ends adjacent said arc tube and distal ends furthermost removed from said arc tube;

an electrical feed through means disposed in each of said end tubes, said feed through means comprising a thin metal foil section disposed between two electrically conductive lead in wires, one of said lead in wires having an electrode disposed thereon and fitted within said discharge zone;

a sealing compound sealing said electrical feed through means to the alumina of said end tubes at the outer ends thereof.

2. The high pressure discharge lamp of claim 1 wherein a molybdenum foil on the electrode feed through forms a seal with the alumina, the molybdenum foil having a thickness of at most 0.5 mm and width of at least 1.0 mm.

3. The lamp of claim 1 wherein the sealing compound is aluminum oxide plus at least one member selected from the group consisting of silicon, dysprosium, strontium, barium, yttrium and calcium.

4. The lamp of claim 1 where the molybdenum foil forms a portion of the lead in wire for the electrode feed throughs.

5. The lamp of claim 1 where the thin metal foil section is molybdenum, edges of the molybdenum foil being beveled to a thickness of less than 0.1 mm.

6. The lamp of claim 1 where the lead in is a molybdenum or niobium rod welded to the molybdenum foil.

7. The lamp of claim 1 where the molybdenum foil is doped with metal oxide particles.

8. The lamp of claim 1 where said end tubes have slots on the distal ends of said end tubes, said slots having a width substantially the same as said molybdenum foil sections whereby to receive said sections.

9. The lamp of claim 1 wherein there is no niobium or cermet to provide the seal between the feed throughs and the alumina.

10. The lamp of claim 1 where ceramic inserts are placed in the distal ends of said end tubes in order to reduce the sealing compound volume required for sealing molybdenum foil to alumina and, also to support the electrode feed through during sealing.

11. A high pressure discharge lamp comprising a polycrystalline alumina ceramic arc tube forming a discharge zone and means on both sides thereof to seal said tube, said discharge zone containing light emitting materials comprising metal halides and mercury and a starting gas comprising argon or xenon;

said means to seal said tube comprising alumina end tubes having a longitudinally extending openings therein disposed at each end of said arc tube and sealed thereto, said end tubes having proximal ends adjacent said arc tube and distal ends furthermost removed from said arc tube;

an electrical feed through means disposed in each of said end tubes, said feed through means comprising a thin metal foil section disposed between two electrically conductive lead in wires, one of said lead in wires having an electrode disposed thereon and fitted within said discharge zone;

a sealing compound sealing said electrical feed through means to the alumina of said end tubes at the outer ends thereof;

the lamp of claim 1 wherein the sealing compound is oxide plus at least one member selected from the group consisting of silicon, dysprosium, strontium, barium, yttrium and calcium;

the lamp of claim 1 where the thin metal foil section is molybdenum, edges of the molybdenum foil being beveled to a thickness of less than 0.1 mm;

the lamp of claim 1 wherein there is no niobium or cermet to provide the seal between the feed throughs and the alumina.

* * * * *